United States Patent [19]

Stromquist

[11] 4,306,140

[45] Dec. 15, 1981

[54] INSULATIVE MULTI-PANE HEATED WINDOW STRUCTURE

[75] Inventor: Michael E. Stromquist, Encino, Calif.

[73] Assignee: Anthony's Manufacturing Company, Inc., San Fernando, Calif.

[21] Appl. No.: 94,156

[22] Filed: Nov. 14, 1979

[51] Int. Cl.[3] ..... H05B 3/06

[52] U.S. Cl. ..... 219/522; 62/248; 219/203; 219/218; 219/509; 219/543; 312/138 R; 219/214

[58] Field of Search ..... 219/203, 214, 218, 509, 219/511, 522, 543, 552; 62/248; 312/138 R; 52/171; 200/61.06; 244/134 D; 338/308, 309

[56] References Cited

U.S. PATENT DOCUMENTS

| | | | |
|---|---|---|---|
| 2,927,441 | 3/1960 | Sharpe et al. | 62/248 |
| 3,263,063 | 7/1966 | Marriott et al. | 219/522 |
| 3,379,859 | 4/1968 | Marriott | 219/522 |
| 3,449,551 | 6/1969 | Aisanich | 219/511 |
| 3,475,594 | 10/1969 | Aisanich | 219/509 |
| 3,526,753 | 9/1970 | Aisanich | 219/522 |
| 3,612,821 | 10/1971 | Stromquist | 219/218 |
| 3,655,939 | 4/1972 | Stromquist | 219/218 |
| 3,911,245 | 10/1975 | O'Shaughnessy | 219/218 |
| 4,035,608 | 7/1977 | Stromquist | 219/218 |
| 4,206,615 | 6/1980 | Sobajima et al. | 62/248 |

*Primary Examiner*—Volodymyr Y. Mayewsky
*Attorney, Agent, or Firm*—Morganstern, Mann & Smith

[57] ABSTRACT

A structure adapted for use in a door of a refrigerated compartment. The door may include a plurality of panes of glass, a plurality of spacers for spacing the plurality of panes of glass so as to form an air space between each pair of panes of glass, a conductive coating applied to one surface of one of the panes of glass facing into the air space between the panes of glass, and an electrical circuit connected to the conductive coating on the coated surface of the pane of glass. The electrical circuit includes a portion which could otherwise be exposed to physical contact through the air space in the event of breakage of the coated or opposing pane of glass. The structure includes a portion for blocking physical contact with the portion of the electrical circuit which could otherwise be exposed. The structure further includes portions for connecting with the spacers in the door for securing the structure in the door.

7 Claims, 5 Drawing Figures

INSULATIVE MULTI-PANE HEATED WINDOW STRUCTURE

BACKGROUND OF THE INVENTION

1. Field of the Invention

The invention relates generally to safety devices, and relates specifically to a structure adapted for use in a door of a refrigerated compartment, for preventing physical contact with a portion of an electrical circuit which could otherwise be exposed.

2. Description of the Prior Art

Refrigerated compartments are utilized for the display and sale of a wide variety of products, such as food products including dairy and meat, and beverages such as wine. Such refrigerated compartments often include doors for access thereinto, and each door may include two or more glass panes therein. The panes are spaced apart by spacers which extend about the top, bottom and sides thereof so as to form at least one insulating air space therebetween. The panes are bonded together at the edges thereof, and a frame holds the panes in the door.

By virtue of the temperature differential between the temperature outside and inside the refrigerated compartment, the portions of the panes of glass exposed to the relatively high humidity store ambient conditions are subject to the formation of condensation thereon. To prevent the formation of such condensation, the inside surface of one or more of the panes of glass, typically the outer pane, is coated with a transparent conductive coating to which an electrical power supply circuit extends. The circuit is connected on the inner surface of such coated pane, so as to conduct electric current to the conductive coating for heating thereof, to prevent the formation of condensation. The electrical circuit typically includes a bus bar positioned on the inside surface of the coated pane of glass, a conductive lead to the bus bar, and contact means at the point of connection of the conductive lead and bus bar. The bus bar is covered on the outside of the coated pane by the frame holding the glass in the door.

Tempered glass panes have been utilized in such refrigerated compartment doors for safety, as such panes shatter into small pieces upon breakage thereof rather than forming dangerous large pieces of glass. The shattering of the coated pane of glass breaks the continuity of the electrical circuit through the bus bar mounted on the inner surface thereof, which prevents shock from contact therewith. However, a portion of the electrical circuit proximate the contact means normally remains conductive and could be exposed on the inside surface of the pane of glass through the air space. Such otherwise exposed circuit portion may include a portion of the conductive lead, a portion of the bus bar, and the contact means, posing a potential threat to persons coming into physical contact therewith.

SUMMARY OF THE INVENTION

In view of the above, it is among the objects of the invention to provide a structure which prevents physical contact with a portion of an electrical circuit which could otherwise be exposed, so as to prevent potential electrical shock. A futher object of the invention is to provide such a structure which is not subject to dislodging upon breakage of the coated or other pane which could otherwise expose the portion of the electrical circuit. A still further object of the invention is to provide such a structure which does not itself conduct electricity to prevent potential electrical shock.

The above objects, as well as others, are provided for in the invention by means of a structure adapted for use in a door of a refrigerated compartment. The door may include a plurality of panes of glass, a plurality of spacers for spacing the plurality of panes of glass so as to form an air space between each pair of panes of glass, a conductive coating applied to one surface of one of the panes of glass facing into the air space between the panes of glass, and an electrical circuit connected to the conductive coating on the coated surface of the pane of glass. The electrical circuit includes a portion which could be exposed to physical contact through the air space in the event of breakage of the coated or other pane of glass. The structure includes a portion for blocking physical contact with the portion of the electrical circuit which could otherwise be exposed. The structure further includes portions for connecting with the spacers to secure the structure in the door.

DESCRIPTION OF THE DRAWINGS

The invention is illustrated, by way of example thereof, in the accompanying drawings, wherein.

DESCRIPTION OF THE PREFERRED EMBODIMENTS

In the preferred embodiment of the invention, as illustrated in the Figures, the invention comprises a structure 10 adapted for use in a door of a refrigerated compartment.

Figure 1:
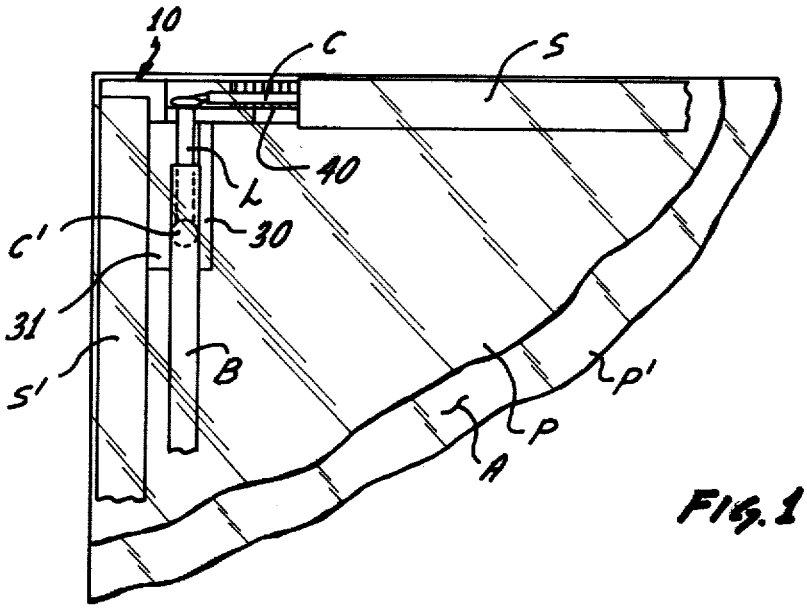
FIG. 1 is an elevational fragmentary view of a structure pursuant to the invention positioned in a door of a refrigerated compartment.
Figure 5:
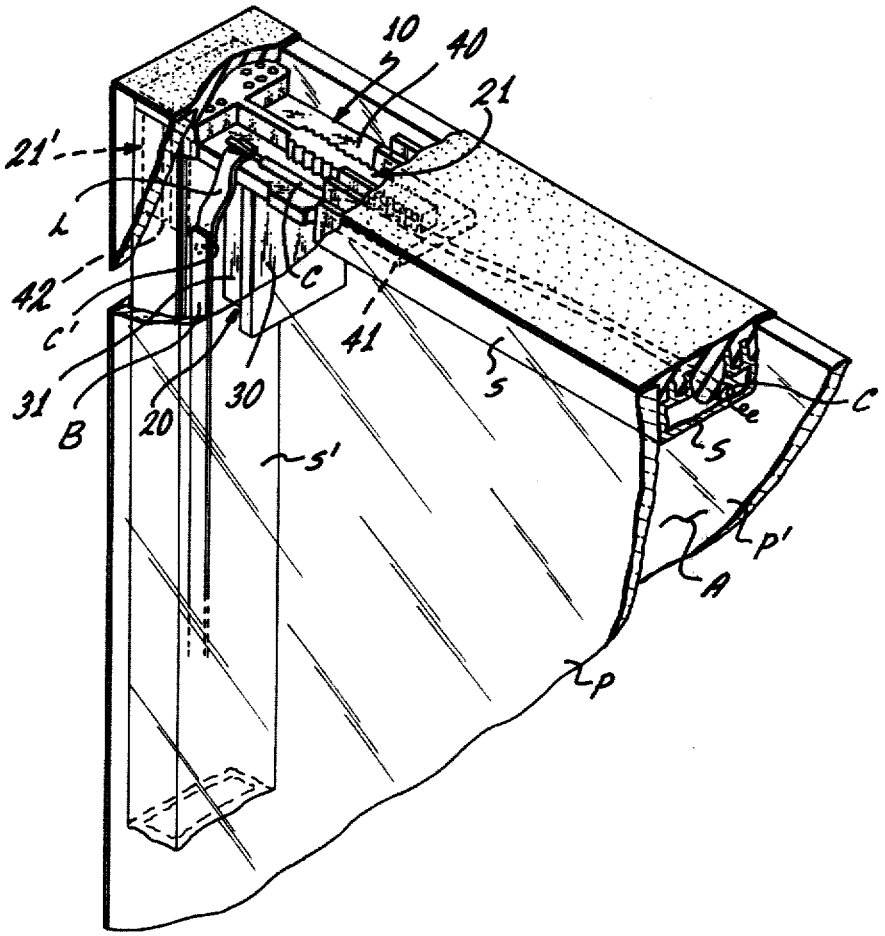
FIG. 5 is a partially cutaway perspective view of a multi-pane door glass panel unit incorporating a structure pursuant to the invention.

The refrigerated compartment door, as illustrated in FIGS. 1 and 5, may include a pair of panes of glass P, P', a plurality of spacers as S, S', for spacing panes P, P' so as to form an air space A therebetween, a transparent conductive coating, applied on the inner surface of pane P facing air space A, and an electrical circuit connected to the conductive coating on the inner surface of coated pane P. the panes are bonded together at the edges thereof, and a frame (not shown) holds the panes in the door. The electrical circuit includes a conductor C, connectable to a source of electricity, a bus bar B applied to the inner surface of pane P facing air space A, a conductive lead L, connected to conductor C, and contact means C' connecting conductive lead L and bus bar B. The bus bar is normally covered on the outside of the coated pane by the frame holding the glass in the door. A portion of the electrical circuit which could otherwise be exposed to physical contact through the air space in the event that coated pane P breaks includes part of conductive lead L, part of bus bar B, and contact means C'.

Figure 2:
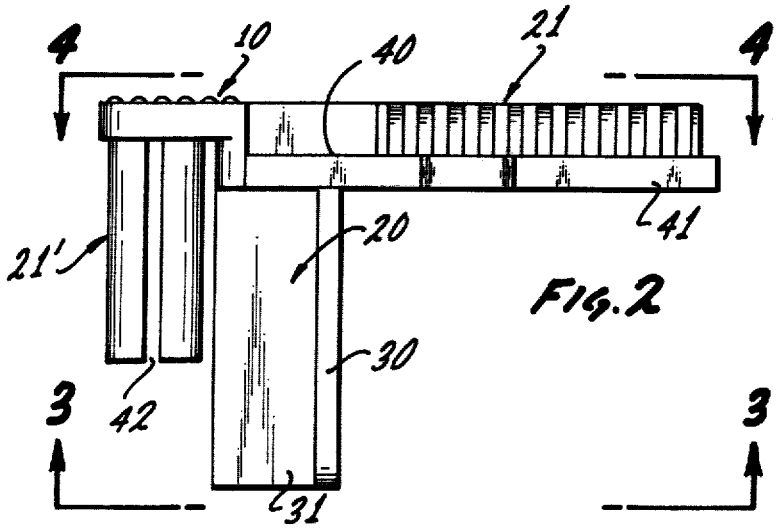
FIG. 2 is a side elevational view of the structure pursuant to the invention.
Figure 3:
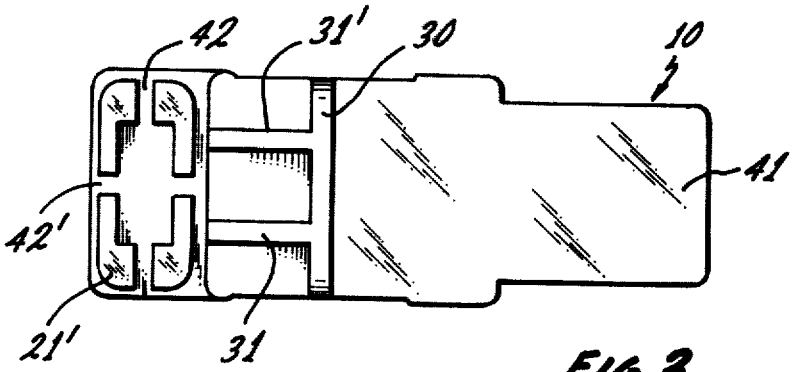
FIG. 3 is a bottom view taken on line 3—3 in FIG. 2.
Figure 4:
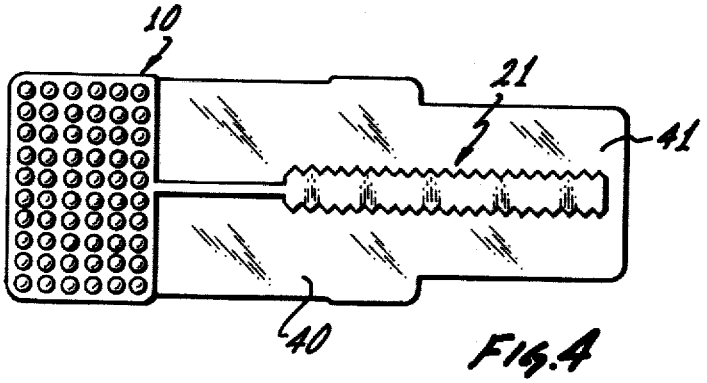
FIG. 4 is a top view taken on line 4—4 in FIG. 2.

Structure 10, as illustrated in FIGS. 2-4, is comprised of nonconductive material, such as plastic, and includes a portion 20, for blocking physical contact with the portion of the electrical circuit which could otherwise be exposed in the event coated pane P breaks, and portions 21, 21' for connecting article 10 with top spacer S and side spacer S' respectively.

Portion 20 of structure 10 includes a part 30 for extending into the air space A between panes P, P', and parts 31, 31', for supporting part 30 on side spacer S'. Part 30 extends in a plane substantially parallel to side spacer S', and parts 31, 31' extend in a plane substantially perpendicular to side spacer S'.

Portion 21 includes a part 40 for supporting conductor C thereon, and a part 41 for connecting with top spacer S. Portion 21' is generally tubular in shape, and has slots 42, 42' formed therein.

Structure 10 is adapted for use in a door of a refrigerated compartment by interconnecting portion 21 thereof with top spacer S, by interconnecting portion 21' thereof with side spacer S', and by securing panes of glass P, P' thereabout.

In the event either pane P or P' breaks, it shatters into small pieces by virtue of the tempering thereof. Breakage of pane P breaks the continuity of the electrical circuit through bus bar B, with the possible exception of a portion of the electrical circuit, which may include part of conductive lead L, part of bus bar B, proximate contact means C' and contact means C'. Physical contact with the portion of the electrical circuit which could be exposed through the air space A is prevented by portion 20 of structure 10, which extends into air space A about such portion so as to prevent physical contact therewith.

Portion 20 of structure 10 prevents physical contact with the portion of the electrical circuit which could be otherwise exposed, so as to prevent potential electrical shock. Portions 21, 21' prevent the structure from being subject to dislodging upon breakage of the coated pane which could otherwise expose the portion of the electrical circuit. Structure 10 is comprised of nonconductive material, so as to prevent potential electrical shock from physical contact therewith.

The preferred embodiment of the invention has been set forth above. It is to be understood, however, that variations may be made in such preferred embodiment, which variations may nevertheless be within the scope and spirit of the invention. The invention is therefore to be broadly construed, within the scope and spirit of the claims appended hereto.

I claim:

1. An insulative multi-pane heated window structure interposable between a colder region and a warmer region to permit vision therebetween, comprising:

a first glass pane fabricated from material adapted to shatter into small pieces upon breaking thereof and having outer and inner surfaces, said first pane outer surface being positioned in normal use proximate the warmer region;

a second glass pane;

spacer means for maintaining said first and second glass panes in a substantially parallel, spaced relationship so as to form an insulating air space therebetween;

a substantially transparent electrically conductive heating film bonded to the inner surface of said first pane so as to fracture therewith;

a pair of spaced bus bars bonded to the inner surface of said first pane so as to fracture therewith, one of said bus bars being in electrical contact with one of the edges of said film, the other of said bus bars being in electrical contact with the opposite edge of said film;

electrical contact means for connecting one of said bus bars to a source of electrical power; and shielding means positioned within the insulating air space for preventing physical contact with the portion of the assembly proximate the electrical contact means in the event of breakage of said first pane.

2. The structure of claim 1 wherein said spacer means comprises a plurality of spacers positioned about the periphery of said first and second panes and wherein said shielding means includes an attachment means for attaching said shielding means to at least one of said spacers.

3. The structure of claim 2 wherein said shielding means further includes a blocking portion connected to said attachment means and extending into the insulating air space in the area proximate the electrical contact means for preventing physical contact with either said electrical contact means or the bus bar portion proximate said electrical contact means.

4. The structure of claim 3 wherein said shielding means blocking portion is of electrically nonconductive material.

5. The structure of claim 1 wherein said shielding means is of electrically nonconductive material.

6. The structure of claim 1 wherein said spacer means comprises a plurality of tubular spacers positioned about the periphery of said first and second panes and wherein said shielding means include an elongated projection portion adapted to extend into one of said tubular spacers to be fixedly positioned thereby.

7. The structure of claim 1 further comprising:

a third glass pane;

second spacer means for maintaining said second and third glass panes in a substantially parallel, spaced relationship so as to form a second insulating air space therebetween.

* * * * *